US006478055B2

(12) United States Patent
Dewispelaere

(10) Patent No.: US 6,478,055 B2
(45) Date of Patent: Nov. 12, 2002

(54) PULLEYLESS SHED-FORMING DEVICE FOR A WEAVING MACHINE

(75) Inventor: Andre Dewispelaere, Marke (BE)

(73) Assignee: N.V. Michel Van de Wiele, Kortrij/Marke (BE)

( * ) Notice: Subject to any disclaimer, the term of this patent is extended or adjusted under 35 U.S.C. 154(b) by 0 days.

(21) Appl. No.: 09/983,706

(22) Filed: Oct. 25, 2001

(65) Prior Publication Data

US 2002/0046778 A1 Apr. 25, 2002

(30) Foreign Application Priority Data

Oct. 25, 2000 (BE) ..... 000679

(51) Int. Cl.[7] ..... D03C 3/06; D03C 3/12; D03C 3/20

(52) U.S. Cl. ..... 139/455; 139/55.1; 139/66 R

(58) Field of Search ..... 139/455, 55.1, 139/66 R, 435.1, 59, 65

(56) References Cited

U.S. PATENT DOCUMENTS

| | | | | |
|---|---|---|---|---|
| 4,515,186 A | * | 5/1985 | Durville et al. | 139/319 |
| 4,702,286 A | * | 10/1987 | Palau et al. | 139/455 |
| 5,333,652 A | * | 8/1994 | Bassi et al. | 139/455 |
| 6,073,662 A | * | 6/2000 | Herbepin et al. | 139/455 |
| 6,073,663 A | * | 6/2000 | Dewispelaere | 139/455 |

FOREIGN PATENT DOCUMENTS

| | | |
|---|---|---|
| DE | 965 570 | 5/1957 |
| EP | 779384 | 6/1997 |
| EP | 930385 | 7/1999 |
| EP | 982419 | 3/2000 |
| FR | 2503741 | 10/1982 |
| GB | 2047755 | 12/1980 |
| JP | 60 173135 | 9/1985 |

OTHER PUBLICATIONS

Derwent Abstracts: (3) (2 pages).

* cited by examiner

*Primary Examiner*—A Vanatta
*Assistant Examiner*—Robert Muromoto, Jr.
(74) *Attorney, Agent, or Firm*—James Creighton Wray; Meera P. Narasimhan

(57) ABSTRACT

A pulley-less shed-forming device for a weaving machine, such as a jacquard machine, has a number of shed-forming elements (1), such as hooks, to determine the positions of one or more warp yarns on a weaving machine. A lifting device (50), (51) moves the shed-forming elements (1) up and down. At least one actuator (40)–(44), (80), (83) is provided for selectively influencing the shed-forming element (1), so that it is either kept at a fixed height, or is moved by means of the lifting device (50), (51). The element (1) has at least one selection body (7), (8), (9) which, for said selective influencing, may be moved into first or second stable positions, as desired, by an actuator (40)–(44), (80), (83) forming a shed-forming element (1) in itself. It may also be formed as a device without a pulley. Because the positions of the selection body are stable, their position may be changed by a single temporal influence by the actuator making the device energy efficient.

31 Claims, 6 Drawing Sheets

Figure 4:
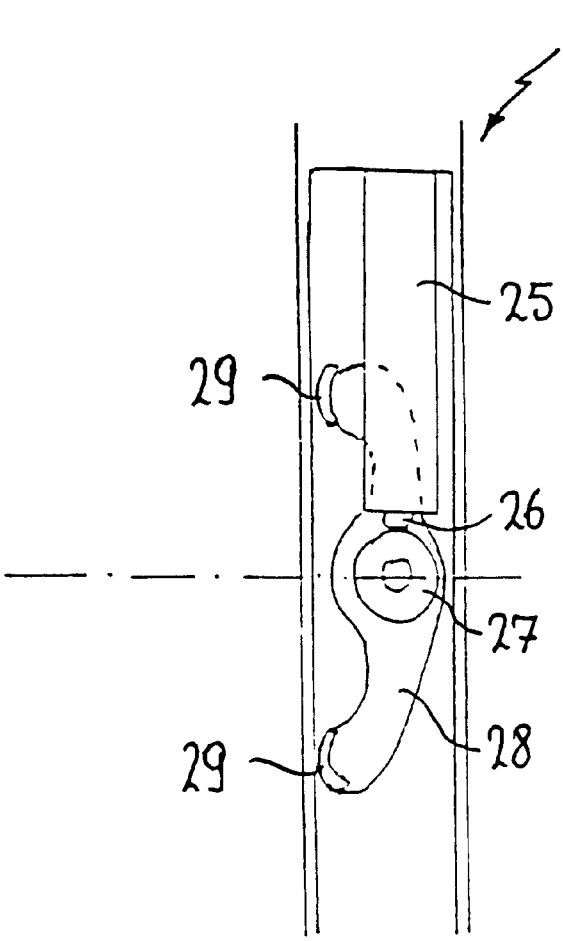

FIG. 1
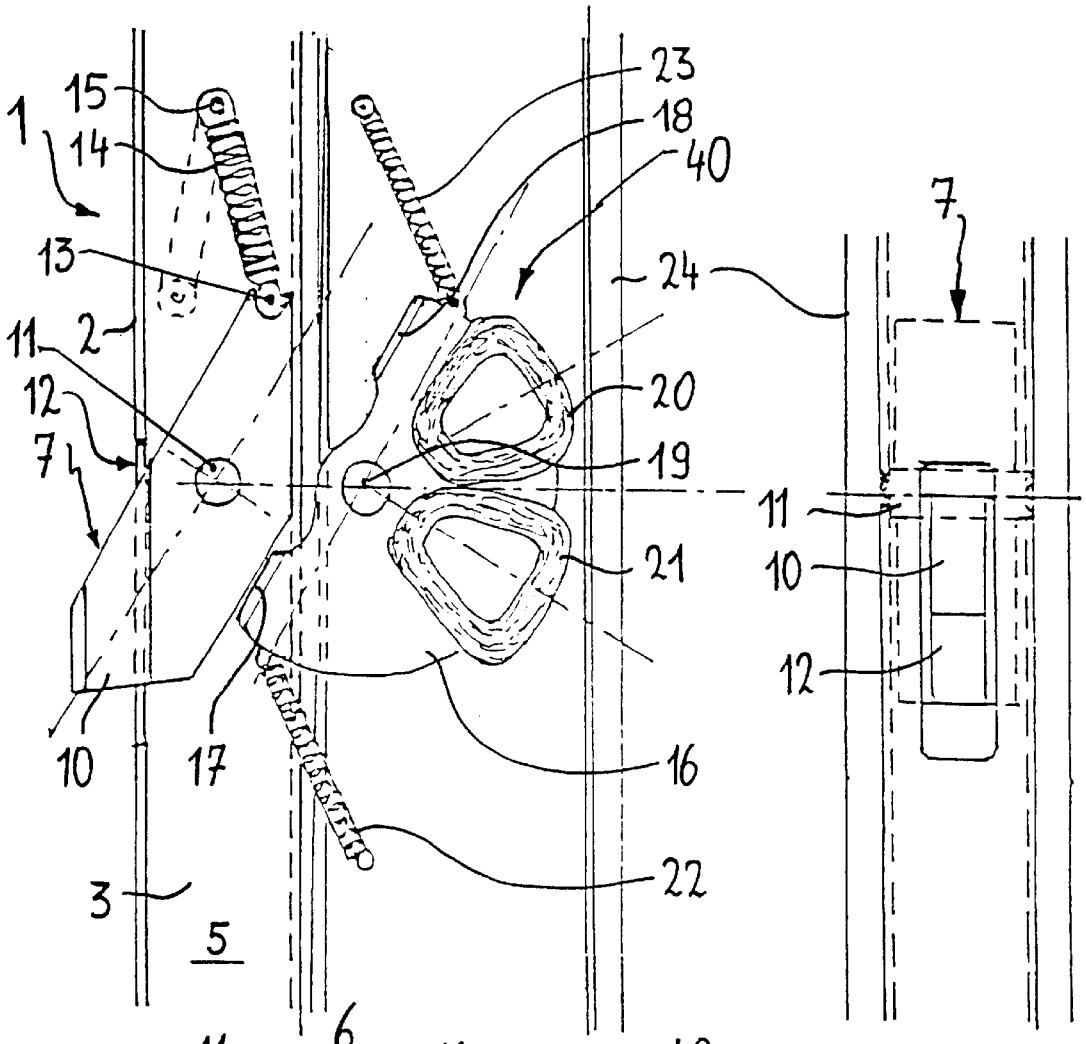
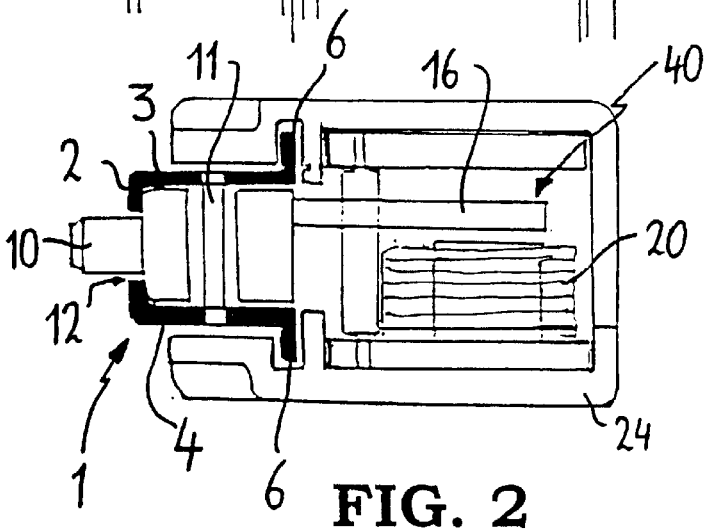
FIG. 2
FIG. 3

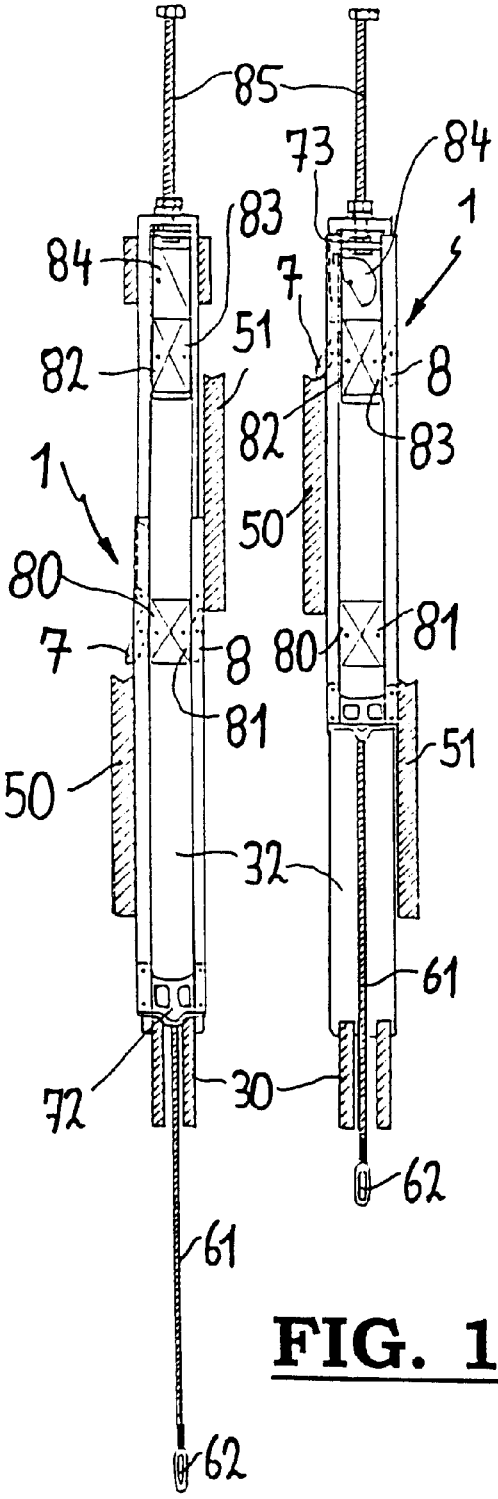
FIG. 13
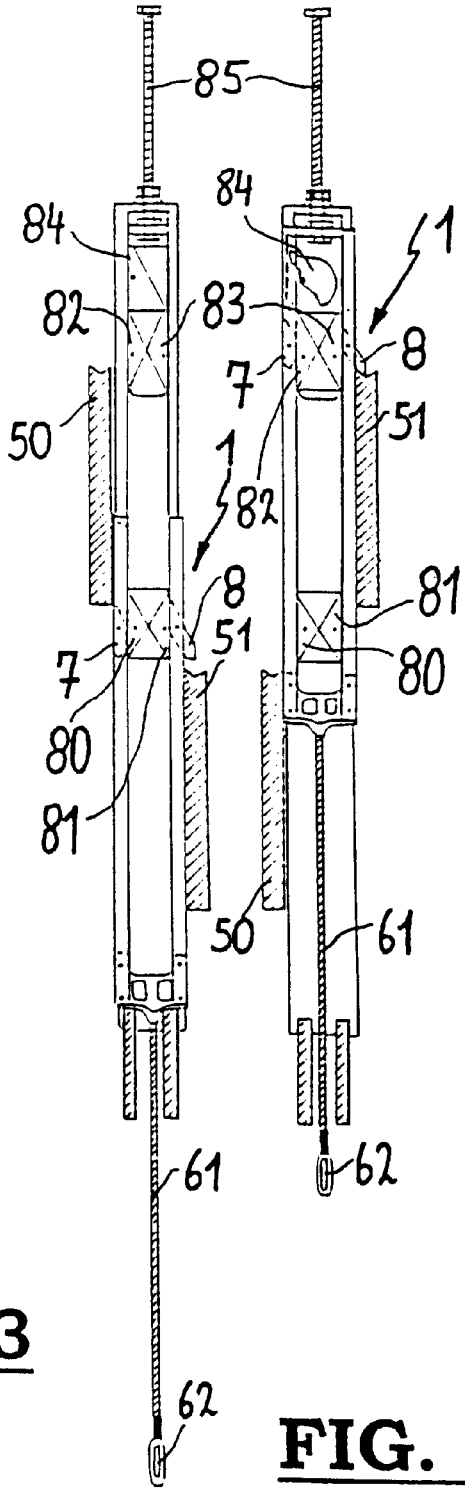
FIG. 15
FIG. 12
FIG. 14

PULLEYLESS SHED-FORMING DEVICE FOR A WEAVING MACHINE

This invention relates to a shed forming device, such as for instance a jacquard machine, comprising at least one shed-forming element to determine the positions of one or more warp yarns on a weaving device, a lifting means provided for moving up and down the shed-forming element, and at least one actuator provided for selectively influencing the shed-forming element, so that it either stays at a fixed height, or is moved by the lifting means.

More particularly this invention concerns a weaving device provided with a shed-forming device according to this invention.

In addition, a shed-forming element (e.g. a hook) for determining the positions of one or more warp yarns on a weaving device, which has been provided for being selectively influenced by an actuator of a shed-forming device, is within the scope of this invention. More particularly such a shed-forming element has then been provided to be selectively influenced by an actuator or/and a shed-forming device according to this invention.

Shed-forming devices with the characteristics mentioned above are well known and are mainly used to form a shed during successive weaving cycles on a weaving machine each time between a series of warp yarns, in which the warp yarns take up such a position with respect to one or more inserting levels, that after having inserted the weft warp yarns on this inserting levels a fabric is formed having the structure desired and possibly the design or pattern desired.

A known shed forming device—which has been described in GB 2 047 755—is a two-position-open-shed jacquard machine on which the warp yarns may be brought at two heights and which allows during each cycle either to keep those warp yarns (according to the open-shed principle) at the same height as during the preceding cycle or to bring them at a different height, as desired.

For that purpose, this device disposes of two knives which may be moved up and down in opposition and a series of sets of two co-operating shed-forming elements, called hooks, which may be moved up and down by a respective knife and which in their upper position may be elastically deformed by means of electromagnets in order to hook on to a holding lutch provided for at a fixed height. The shed-forming elements are connected to each other by a pulley cord thrown around and led under a pulley of a pulley element. The pulley element itself is connected to one or more harness cords, which, in turn, are connected to their respective warp yarns.

By making the hooks and the knives moving up and down or by selecting one of the hooks in its upper position, so that it is held in the upper position, the warp yarns my be brought into or kept in one of two different positions during each cycle.

In EP 0 214 075 a similar two-position-open-shed shed-forming device is described. This device differs from the device described above, in that the pulley element now comprises an upper and a lower pulley, where the pulley cord, connecting the two hooks is thrown around the upper pulley and a second pulley cord is thrown around the lower pulley from a fixed fastening point and is further connected to the warp yarns and in that the selection of the hooks in their upper position may now occur by an elastic deformation of two strips with hook-shaped extremities by means of an electromagnet.

Both devices function with a pulley device and pulley cords. This system has several disadvantages. Rolling the pulley cords off the pulleys causes the pulley cords to wear out so that they might break easily. The pulley elements function in the dusty environment of a weaving mill, as a result of which they will get jammed by the effect the dust has on their bearings. At the high working speed of modern weaving machines, the pulley devices develop frictional heat, which has a negative influence on the duration of the pulley cords and a ventilation device should be provided for, in order to evacuate this heat. Furthermore replacing parts of these pulley device (pulley cords, pulley elements) in case of break or wear is a particularly time consuming job.

The first purpose of this invention is to provide for a shed-forming device for a weaving device, having none of the disadvantages mentioned above.

There are shed-forming devices which function without a pulley device and which do not show the above-mentioned disadvantages. Such a pulleyless shed-forming device was described, among others, in EP 0 779 384.

This shed-forming device works with a U-shaped flexible hook, which is connected to one or more harness cords without a pulley element intervening and of which the upper part of the two legs has the shape of a hook and on which respective knives may hook to be moved upwards, with the hook resting on a bottom board. The knives move up and down in opposition. An electromagnet, situated between de legs of the hook is used to bend the hooks elastically towards each other, so that the hook-shaped extremities of these legs get outside the pick-up range of the knives. In BE 9800036 and BE 9800035 also, similar shed-forming devices are described.

However, these pulleyless devices have a new problem, namely when a hook is coupled with one leg to a rising knife, then the other descending knife will hit the top of the other leg of the rising hook, and when one leg of a hook is coupled to a descending knife, then the other rising knife will pick up again the descending hook at the hook-shaped extremity. To avoid these unwanted phenomena, the known devices provide for a supplementary control with the intention to make the hook leg concerned give way in these critical moments.

This avoiding movement has to be performed each time at full speed of the moving hook. This makes the control rather complicated and consequently the moving hooks will suffer from supplementary friction with more production of neat. Moreover, the devices described are insufficiently suitable to adapt the lifting of the hooks and to adjust the inclination of the shed to be for med.

In addition, the electromagnet is expected to influence the position of a hook leg over its entire length. For that purpose, a rather large passing space is needed for the hook legs as a result of which the electromagnets have to work with a rather large air gap and as a result of which the selection system is no longer able to function with sufficient efficiency. In order to increase efficiency, stronger electromagnets are needed, but they have the disadvantage that they consume quite some electric energy.

A second purpose of this invention is to provide for a shed-forming device with the help of which the disadvantages of the known pulleyless shed-forming devices mentioned above may be remedied.

According to this invention the objects mentioned above are obtained by providing for a shed-forming device comprising at least one shed-forming element to determine the positions of one or more warp yarns on a weaving device, a lifting means provided for to move the shed-forming element up and down, and at least one actuator provided for to influence the shed-forming element selectively, so that it is either kept at a fixed height or is moved by means of the lifting means, and of which, according to the invention, each shed-forming element comprises at least one selection body which, in order to obtain said selective influencing, may be put, as desired, in a first or in a second stable position by means of an actuator.

Of course, the said aims are likewise achieved by providing for a shed-forming element to determine the positions of one or more warp yarns on a weaving device having the characteristics mentioned above. A shed-forming element that has been provided for to be selectively influenced by an actuator of a shed-forming device and that comprises, according to his invention, at least one selection body, whereas this selection body, for the said selective influencing, as desired, may be put in a first or second stable position by means of the actuator, and is therefore in itself an object of this invention.

Because the said positions of the selection body are stable, it is possible to change the position of the selection body by influencing it temporarily only once by means of the actuator. After the selection body has taken up its required position, no further influencing is needed.

For each co-operating lifting means, each shed-forming element may comprise a different selection body, with which, in the first stable position, it is within the pickup range of the lifting means and is therefore able to rest on the lifting means concerned and in the second stable position will come outside this pick-up range. Each time, a shed-forming element should be moved by a well-defined lifting means, the selection body co-operating with this lifting means is shifted into the first position, whereas each time the selection body not needed at that moment may stay in the second position. With this, the hitting problem mentioned above may be solved without any friction and in a particularly efficient manner. Moreover, the actuator may be carried out such that it only consumes energy when it moves a selection body into an other position. Therefore, such a shed-forming device is moreover particularly economic as far as energy is concerned.

The actuator may further be carried out in such a way, that it comprises a part that is movable by an electromagnetic force which in turn is provided for to transfer a mechanical force to a selection body in order to change the position of this selection body. The bobbin and the movable part are both part of the actuator, which may be installed as a separate unit, apart from the shed-forming element, so that a minimal air gap may be provided for.

Furthermore, the lifting height of the shed-forming elements may also be rather easily changed with a similar shed-forming device. In addition to the change of the lifting height of the knives, it is indeed sufficient to change the height setting of the actuators in a corresponding manner. The actuators of a same device may be set at different lifting heights rather easily, what may be needed when an inclination of the shed to be formed is adjusted (where, for instance, the lifting height of the hooks is gradually increasing from front to back in the shed-forming device). It is indeed sufficient to install these actuators on a supporting construction, which may be installed in a corresponding inclined position.

Therefore a shed forming device according to this invention may be carried out and function without a pulley device so that the problems mentioned above with respect to pulley devices are remedied on the one hand, but on the other hand making it possible that the danger of the knives hitting the hook may be avoided in a very simple and effective manner without this causing any disadvantages and more particularly without the disadvantages described above connected to the known actuator control to make the hook give way and moreover it is much better suitable for an adaptation of the lifting height of the shed-forming elements to be carried out and for adjusting an inclination of the shed to be formed.

The shed-forming device according to this invention on the one hand and the shed-forming element according to this invention on the other hand are preferably carried out in such a way that the selection body is movable between two end positions with respect to the shed-forming element, and that the shed-forming element comprises a push means which is provided for transferring a mechanical force to the selection body, in order to change the position of the selection body. The bobbin and the movable part are both part of the actuator, which as a separate unit, apart from the shed-forming element, may be installed, so that a minimal air gap may be provided for.

Furthermore, also the lifting height of the shed-forming elements may be changed rather easily with a similar shed-forming device. It is indeed sufficient to change the installation height of the actuators in a corresponding manner in addition to a change of the lifting height of the knives. The actuators of a same device may likewise be installed at different lifting heights rather easily, what may be needed when an inclination of the shed to be formed has to be adjusted (the hooks, for instance, obtaining a gradually increasing lifting height from front to back).

It is indeed sufficient to install those actuators on a supporting construction, which may be put in a corresponding inclined position.

Therefore a shed-forming device according to this invention may be implemented and function without a pulley device on the one hand, so that the problems mentioned above with respect to pulley devices are remedied, on the other hand, makes it possible, in a very simple and efficient manner, to avoid that the knives might hit the hook and that without causing any disadvantage and more particularly without causing the disadvantages described above, involved in the known actuator control to make the hook turn aside and is moreover much better suitable for an adaptation of the lifting heights of the shed-forming elements and for an inclination of the shed to be formed to be adjusted.

The shed forming device according to the invention on the one hand and the shed forming element according to this invention on the other hand are preferably carried out in such a way that the selection body is movable between to end positions with respect to the shed-forming element, and that the shed-forming element comprises a push means which has been provided to exert a force on the selection body which counteracts the movement of the selection body from any end position in the direction of the other end position, so that the selection body may be kept stable in the said end positions.

A similar shed-forming element may be effectuated with the help of very simple means and at a low cost price, whereas the stability of the end positions of the selection body is yet well assured.

The push means may be a spring for instance, which, on one side is connected to the selection body and on the other side connected to the shed forming-element, so that the spring force exerted on the selection body counteracts the movement of the selection body from any end position.

By a suitable choice of the spring, the stability may be adapted to the in-use conditions of the shed-forming element. The spring force should be sufficient to prevent the selection body from being accidentally moved from one into another stable position (for instance by impacts or chocks). Preferably, a compression spring is used.

In a preferred embodiment, the shed-forming element comprises two stops, which limit the path length of the movement of the selection body and determine the said end positions.

A very reliable shed-forming element to be realized in a particularly simple way, is obtained when each of its selection bodies is installed to face an opening in a wall of the shed-forming element and protrudes through this opening in at least one of its stable positions, and when the said stops are formed by respective edges of this opening.

In a particularly preferred embodiment, each selection body is rotatable between the said stable positions with respect to the shed-forming element.

In a particular embodiment of the shed-forming device according to this invention, each shed-forming element may be selectively influenced by means of at least one actuator whose installation height is variable.

The actuator may be carried out as a separate unit and installed beside the path of the movement of the shed-forming element. If this installation height is variable, the shed-forming device may be very easily adapted to the modified lifting height of the knives. Suffice it to adapt the installation height of the actuators.

This is particularly the case if at least one selection body of each shed-forming element may be selectively influenced by means of at least two actuators installed at different levels, whereas the difference in height between these two levels is variable.

Then the lower actuator is installed, for instance, on the level of a selection body when the shed-forming element has taken up its lower position, whereas an upper actuator is installed at the level of the same selection body when the shed-forming element is in its upper position. When the difference in height between the two actuators is variable, the installation of the actuators is very easily adaptable to a modified lifting height.

Preferably each shed-forming element comprises at least one selection body which has been provided to arrive in a first stable position within the pick-up range of a lifting means, so that the selection body may rest on this lifting means, whereby the shed-forming element is moved to come in a second stable position outside this pick-up range.

Preferably the shed-forming device comprises two lifting means movable up and down in opposition, whereas each shed-forming element comprises two selection bodies which are provided to come in a first stable position within the pick-up range of a respective lifting means, so that the shed-forming element may be moved by the lifting means, and to stay in a second stable position outside this pick-up range.

A similar shed-forming device may be carried out as a two-position-open-shed shed-forming device without pulley device.

The two lifting means may be provided either to move up and down in opposition one above the other, or to move up and down in opposition one beside the other.

In order to co-operate with two lifting means, which are movable up and down in planes situated next to each other, the shed-forming element may be carried out with two legs in which respective selection bodies are provided. A similar shed-forming element is then carried out, for instance, in a U-shape with two parallel legs with respective selection bodies and with a fixing point for a harness cord in the middle of the connecting piece.

In order to co-operate with two lifting means, which are movable up and down one above the other (for instance in a same vertical plane) the shed-forming element may be carried out as an oblong unit in which the selection bodies are provided one above the other. A similar shed-forming element may be carried out in a rod-shaped form with an internal space that is at least partially surrounded by walls. The selection bodies may be provided between these walls. Preferably, an opening for each selection body has been provided for to let the selection body pass, so that it may come within the pick-up range of a lifting means and so that the edges of these openings form stops to limit the path of the movement of the selection body concerned.

Furthermore, this shed-forming device comprises preferably also a holding means for each shed-forming element, provided at a fixed height, while each shed-forming element comprises a selection body which is provided, in a first stable position, to come in a holding position with respect to this holding means, the shed forming element being held at a fixed height by cooperating with the holding means, and to come in a second stable position in a non-holding position with respect to the holding means.

The installation height of this holding means may also be made adjustable, so that the lifting height of the shed-forming elements may be easily modified.

In a particularly preferred embodiment of these shed-forming devices each selection body and each actuator co-operating with it are carried out in such a way that the force exerted by the actuator on the selection body in order to move this selection body from one stable position into the other is exerted in a direction where the force may not be counteracted by a force which is the consequence of a movement of the shed-forming element by means of a lifting means. Because of this, it is avoided that the shed-forming element will counteract the actuator or will even block it.

In a preferred embodiment, each actuator comprises a movable push element with which the selection body may be pushed from the first into the second stable position and the other way round.

Preferably each actuator comprises also a driving means, with which the push element may be moved into a first and a second push position in order to bring a selection body into the first and second stable position respectively, while the push element is provided to take up a neutral position between these push positions when the driving means is not exerting any driving power on the push element.

With a similar actuator, only energy is consumed when the actuator has to move the push element to move the selection body into another position.

By using a similar actuator, this shed-forming device consumes very little energy.

The push element may either be movable in a linear way or be rotatable between the two said push positions.

Preferably, each actuator comprises an electromagnetic driving means for moving the push element. A preferred actuator consists of a plate-like rotor made of ferromagnetic material on which permanent magnets with alternating north and south poles are installed and a number of poles are installed opposite this rotor around which solenoids are installed to generate an axial flux, which, depending on the polarity of the current will make the rotor turn in one or the other direction. Other possible turning actuators function by the principle of motors with radial flux, such as, for instance, the stepper motor. In addition, an ultrasonic piezo motor or a nano motor or linear actuators, such as electro plunger magnets, among others, may be used.

A particularly advantageous embodiment of this shed-forming device comprises a series of shed-forming elements, which, by one or more lifting means are movable in height and a number of holding means to hold these shed-forming elements at a fixed height, while a number of holding means co-operating with different shed-forming elements are part of a same holding construction which may be installed in an inclined position, so that the installation height of these holding means increases gradually in the direction of the inclination.

This embodiment makes it particularly simple to adapt the installation heights of the holding means to the adjustment of an inclination of the shed to be formed.

In an other very advantageous embodiment the device comprises a series of shed-forming elements which are movable in height by one or more lifting means, while an actuator is provided for at least one selection body of each shed-forming element at a height which corresponds to the height of the selection body when the shed-forming element is moved upwards over a lifting height by a lifting means, and while a number of actuators, co-operating with different shed-forming elements are part of a same supporting construction which may be installed in an inclined position, so that the height setting of the actuators is gradually increasing in the direction of the inclination.

This embodiment also makes it very simple to adapt the installation heights of the actuators to the adjustment of an inclination of the shed to be formed.

Preferably, the said holding construction and the said supporting construction are connected to each other or are forming together one unit. Therefore, the holding means and the actuators may be put at the exact heights by one single adjustment.

Preferably, the holding construction and/or the supporting construction may also be placed in a non-inclined position and have a variable installation height so that the device may be adapted to a modified lifting height.

If the said holding construction and/or the said supporting construction may be installed in several positions with a different inclination, the inclination of the shed to be formed may be easily changed.

In a most preferred embodiment of this shed-forming device each shed-forming element is movable between a lower and an upper position by means of a first and a second lifting means which are movable in opposition, each shed-forming element comprises a first and a second selection body, per shed-forming element, there is a first and a second actuator provided to co-operate with a first selection body, when the shed-forming element is in its lower position and in its upper position respectively and per shed forming element, there is a third and a fourth actuator provided to co-operate with a second selection body when the shed-forming element is in its bottom position and in its top position respectively.

In the shed-forming device according to this invention, a number of actuators and/or hooks are provided preferably in a common module or cassette. Such a module or cassette may comprise for instance the actuators for two different rows of hooks. Preferably, these actuators then are installed in two rows back-to-back. Then on both sides of the modules or cassettes two rows of hooks are provided, which may co-operate with the same lifting means (row of knives).

The characteristics of the shed-forming device according to this invention indicated above are clarified and illustrated and other characteristics and particulars of the invention are indicated in the following, more detailed description of a number of possible embodiments of a shed-forming device and of a shed-forming element according to this invention.

It may be clear that the only purpose of this description is to clarify the invention on the basis of some examples and so in no way may be considered to be a limitation of the scope of this patent application such as it will be stated in the claims enclosed.

In this description reference is made to the drawings enclosed, of which

Figure 5:
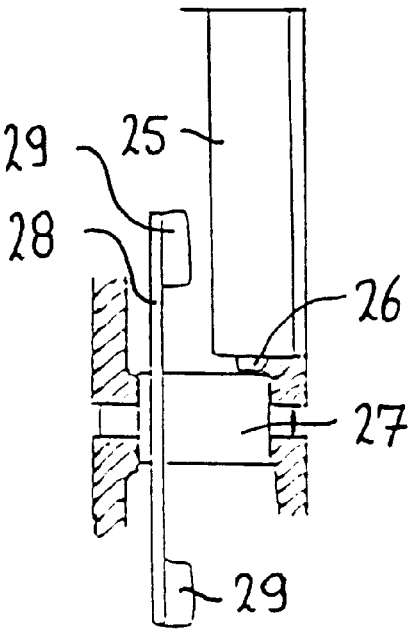
Figure 6:
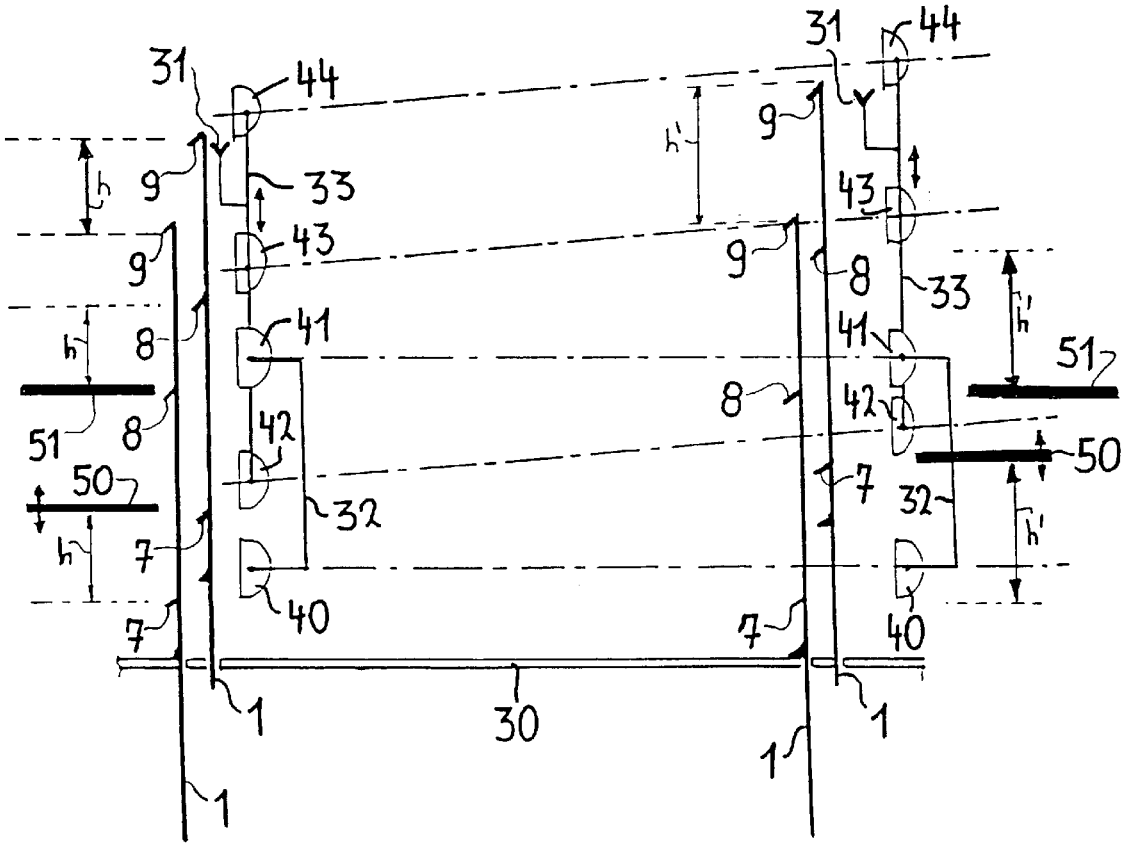
Figure 11:
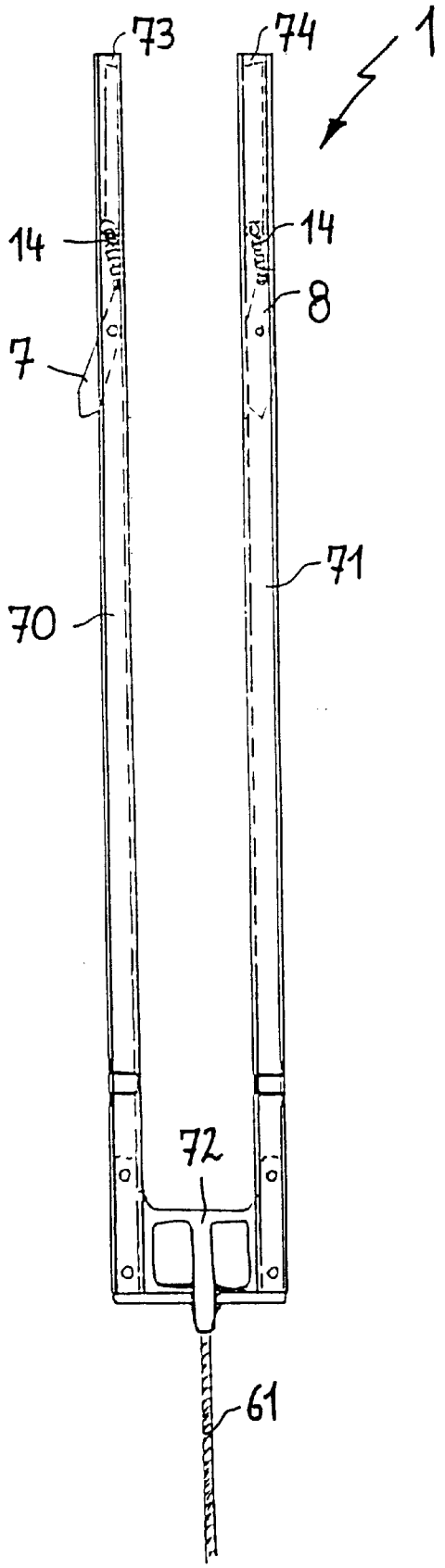

FIGS. 1, 2 and 3 are representing a side view and a top view respectively of an actuator in co-operation with a selection body of a hook according to this invention, FIGS. 4 and 5 represent a side view and a front view of an actuator with a push element driven by a piezo stack, FIG. 6 is a schematic representation of the hooks of a jacquard machine with adjustable lifting and inclination according to this invention, FIGS. 7, 8, 9 and 10 represent a one legged hook and the knives and actuators of a jacquard machine co-operating with this hook in four situations of this co-operation, FIG. 11 shows a front view of a hook with two legs with selection bodies according to this invention, and FIGS. 12, 13, 14 and 15 represent a hook with two legs and the knives and actuators of a jacquard machine co-operating with this hook in four different situations of this co-operation.

A possible embodiment of a jacquard machine according to this invention comprises a large number of hooks (1) installed in different rows and per two adjoining rows of hooks (1) a pair of two knives (50), (51) movable up and down in opposition which are provided to move up and down the hooks (1) of these two rows.

Each hook (1) comprises a number of selection bodies (7), (8), (9) which may take up two stable positions. Each selection body (7), (8), (9) may be brought from one stable position into the other by means of actuators (40), (41), (42), (43), (44) installed to that purpose at different heights along the path of movement of the hooks (1).

The hooks (1) are carried out as an oblong and substantially beam-shaped rod with walls (2), (3), (4) which partially enclose an internal hollow space (5). The hollow space (5) is open at the back and the walls (2), (3), (4) of the hook (1) are bent over on that side, so that they form two wings (6) directed one away from the other, and so that the walls (2), (3), (4) in cross-section show an omega-profile. The walls (2), (3), (4) and wings (6) serve as a guiding surface to keep the hook (1) in a module or cassette (24). A same module or cassette may be provided to guide a large number of hooks (1) of a same row or of adjoining rows.

The selection bodies (7), (8), (9) have a narrow end part (10) which ends in a point and are rotatable between the two parallel side walls (3), (4) of the hook (1) around an axis of rotation (11) at right angles to these walls (3), (4).

The selection bodies (7), (8), (9) are installed one above the other between the walls of the hook. opposite each selection body (7), (8), (9) there is an opening (12) provided in the foremost wall (2) of the hook (1) so that the end part of the selection body (7), (8), (9) concerned may extend through this opening (12) in order to come within the pick-up range of a knife (50), (51).

At the back, in a connecting point (13), each selection body (7), (8), (9) is connected to the end of a compression spring (14) the other end of which is connected to a fixed point (15) of the wall (3) of the hook, so that the selection body (7), (8), (9) is pushed against the upper or the lower edge of the opening (12) under the influence of the spring force into a stable position. In FIG. 1, the compression spring (14) is indicated by a continuous line and by a dashed line to show which are the two extreme positions of this spring.

To bring the selection body (7), (8), (9) from one stable position into the other stable position it is enough to turn this selection body against the spring force till the connecting point (13) where the selection body (7), (8), (9) is connected to the compression spring (14) has passed the line connecting the axis of rotation (11) to said fixed point (15) of the wall (3) of the hook, and the spring force may cause the selection body (7), (8), (9) to turn further into the other stable position.

The spring force exerted by the compression spring (14) may be relatively strong, so that two very stable positions of the selection body (7), (8), (9) are obtained. By exerting a relatively small force (called turn over force) this relatively strong spring force may be overcome to bring the selection body from one stable position into the other.

This turn over force may be delivered by an actuator (40) or selector. As an actuator, all types of driving means may be considered which are capable of making the selection body to turn. The actuator (40) represented in the FIGS. 1, 2 and 3 comprises a rotor (16) that substantially has the form of half a circle and two push surfaces (17), (18). This rotor (16) is rotatable around an axis of rotation (19). It consists of ferromagnetic material on which a number of sectors with permanent magnets with alternating N-S poles have been provided. These sectors are attracted or repelled by the magnetic flux developed by several poles around which solenoids (20), (21), generating an axial flux, have been provided. Under the influence of an electric current flowing through these solenoids (20), (21), depending on the polarity of the current, the rotor (16) will turn in one direction or the other and hit the selection body (7), (8), (9) with its push surfaces (17), (18) so that it will be pushed into one of its two stable positions. The rotor (16) of this actuator (40) is provided with a device with two springs (22), (23) connected to the rotor (16) on one side and to a respective fixed point of the housing (24) of the actuator on the other side, so that these springs (22), (23) exert a respective torque with an opposite sense of rotation on the rotor (16), whereby this rotor (16) is kept in a fixed neutral position when no electric current is flowing through the solenoids of the poles (20), (21). Therefore, in case the actuator (40) should not work there is no consumption of energy. This will save energy.

In addition, linear actuators may be used as an actuator (40), such as, for instance, electro plunger magnets or rotating actuators functioning according to the principle of motors with a radial flux, such as, for instance, stepper motors. An ultrasonic piezo-motor or a nano motor may also be used as an actuator.

In the FIGS. 4 and 5 a different type of actuator (40) is represented. An alternating electric signal in a frequency range of 20 to 140 kHz is applied to a piezo-stack (25). Hereby, the top (26) of this piezo-stack (25) describes an elliptic path, whereby this top (26) will develop a tangential friction force on a tiny shaft (27), whereby this tiny shaft will experience a torque. A push lever (28) with two small push blocks connected to this tiny shaft (27) may be pushed into one or into the other direction to push the selection body (7), (8), (9) into one or into the other stable position by means of one of the small push blocks (29).

In the hooks (1), very schematically represented in FIG. 6, three selection bodies (7), (8), (9) are provided situated above each other. The jacquard machine has a bottom board or bottom grid (30) on which the hooks (1) may rest in a lower position, a holding grid (31) to hold the hooks in an upper position and two knives (50), (51) movable, one above the other, in a same plane, that may be driven in an up and down movement in opposition.

The selection bodies (7), (8), (9) of each hook (1) are represented symbolically by means of small hooks protruding sideways. The actuators (40), (41), (42), (43), (44), which are necessary to act on these selection bodies (7), (8), (9) are mounted on two platforms (32), (33): on a first fixed platform (32), that is connected to the frame of the jacquard machine or to the bottom grid (30), two actuators (40), (41) are placed one above the other for each hook (1), so that they are situated opposite the two selection bodies (7), (8) of the hook (1) and may act on these selection bodies (7), (8) when this hook is on the bottom board (30). On a second platform (33), the height of which is adjustable, three actuators (42), (43), (44) are placed above each other, so that they are situated opposite the selection bodies (7), (8), (9) of the hook (1) and may act upon these selection bodies (7), (8), (9) when this hook (1) has been brought upwards by a knife (50), (51) over a lifting height (h). The second platform is slidable upwards with respect to the frame or the bottom grid (30).

When a hook (1) rests on the bottom grid (30), then it should be possible to couple it to one of the two knives (50), (51) moving up and down in opposition to be brought into the upper position by controlling it. In this position the lower selection body (7) is situated opposite the lower actuator (40) on the fixed platform (32), whereas the middle selection body (8) is then situated opposite the upper actuator (41) on the fixed grid (32). In their one stable position these selection bodies (7), (8) are situated on the path of the movement of a respective knife (50), (51), so that the hook (1) with the selection body (7), (8) concerned may rest on this knife and may be taken along upwards with it. In their other stable position these selection bodies (7), (8) are substantially situated between the walls of the hook (1) and therefore out of reach of the knives (50), (51). In this case, the hook (1) cannot be taken along by a knife (50), (51) and stays to rest in the position down on the bottom grid (30). So, during each "working cycle of a weaving machine, by controlling the actuators (40), (41), a hook may be kept in a lower position or may be brought upwards by a knife (50), (51) moving upwards as desired.

When the hook (1) has been brought up by a knife (50), (51) (a height h above the position below), the upper selection body (9) of this hook (1) is situated level with the holding grid (31) and opposite the upper actuator (44) on the slidable platform (33). By means of the actuator (44), the selection body (9) may be brought into a stable position, where it may rest on the holding grid (31), so that the hook (1) is kept in the upper position.

In the uppermost position of a hook (1), the lower selection body (7) is situated opposite the lower actuator (42) on the slidable grid (33) and the middle selection body (8) is situated opposite the middle actuator (43) on the slidable grid (33). By means of the said actuators (42), (43) these selection bodies (7), (8) may be brought into a first or a second position, as desired, where they may be taken along downwards or not respectively by a respective descending knife (50), (51) to the level of the bottom grid (30). Consequently, during each working cycle a hook (1) may be brought also from an upper to a lower position. Therefore, this jacquard machine is a two-position jacquard machine that may function according to the open-shed principle.

The actuators (40), (41), (42), (43), (44) are activated by an electronic control to bring the hooks (and therefore the warp yarns connected to them), during the weaving procedure, at the desired height in accordance with a chosen pattern to be woven.

In FIG. 6 is illustrated how very easily the lifting and/or inclination of the machine may be adjusted on a jacquard machine according to this invention. For that purpose two hooks (1) are represented on the left hand side of the figure, which are situated at the front of the jacquard machine and on the right hand side two hooks (1) are situated at the back of the jacquard machine. These hooks (1) are represented each time in a lower and in an upper position respectively.

In a jacquard machine with an inclination in the shed opening, the lifting height (h') of the hooks (1) at the back of the jacquard machine is longer than the lifting height (h) of the hooks (1) at the front end. This inclination serves to give the warp yarns an inclination. The selection bodies (7), (8), (9) of the hooks (1) at the front end of the jacquard machine are situated in the upper position of these hooks (1) at a distance above the bottom grid (30) which is smaller than that of the corresponding selection bodies (7), (8), (9) at the back of the jacquard machine. This distance is gradually increasing from front to back in the jacquard machine, depending on the lifting and inclination adjusted. However, the distance between these selection bodies (7), (8), (9) remains the same. To activate these selection bodies three actuators (42), (43), (44) are needed. These three actuators are placed on a second platform (33), adjustable as to height, which is connected to the holding grid (31). This holding grid (31) is made adjustable as to height and as to the inclination corresponding to the lifting and the inclination performed by the lifting knives (50), (51). In this way, it is possible to act upon each selection body (7), (8), (9) of the hook (1), wherever this hook may be situated in the jacquard machine, and the lifting and the inclination may be very easily carried out and there are no limitations to these adjustments.

The embodiment represented in the FIGS. 7 to 10 has two knives (50), (51) which are movable in opposition one above the other. The supporting or coupling surface (on which the hooks may rest) of the upper knife (51) is installed below in form of a protruding rib (52). This embodiment allows the hook (1) to be kept shorter. The lower knife (50) has its supporting surface (53) at the top and has been provided to work between the grid elements (34) of the bottom grid (30). This measure also limits the length of the hook (1).

Below, the hook (1) is provided with a supporting nose (60) with which the hook rests in its position on a protrusion below (35). This protrusion (35) is connected to a fixed platform (32) that is carried out as a wall, which itself rests on a grid element (34). Below, a cord (61) is fastened to the hook (1). This cord (61) has a harness cord connection point (62) to which one or several harness cords with jacquard heddle and return springs are fastened (not represented in the figures).

Immediately above the supporting nose (60) a first lower selection body (7) is provided and a second upper selection body (8) is provided at the top, at a distance almost equal to the maximum lifting height to be performed plus the height of the actuator. Immediately above the upper selection body (8), a holding nose (65) is provided as the top of the hook (1). Instead of this holding nose (65), a selection body might be provided, this selection body being provided to hook into the holding grid in a certain position. A similar holding grid should be placed in an adjustable manner above the upper position of the upper knife (51). This means that the hook (1) should be considerably longer. Moreover, a selection body is more expensive to manufacture than a supporting nose, which may be molded on in plastic.

Opposite the lower selection body (7), a lower actuator (40), and opposite the upper selection body (8), an upper actuator (41) is provided on a first fixed construction (32), that will be called hereafter the fixed platform or the wall. The actuators (42) and (43) which correspond to the upper position of the respective selection bodies (7) and (8) are provided on a second construction (33), adjustable as to height, to be called hereafter the slidable platform or slide. This slidable platform (33) is incorporated in the wall (32) in a slidable manner. The slide (33) has an oblong recess (36) in which the fixed actuator (41) is situated. In the figures, the slide (33) is indicated in its upper position corresponding to the highest lifting. The sliding range of the slide (33) is determined by the distance between the actuator (42) and the fixed actuator (40) and between the actuator (43) and the fixed actuator (41). This distance is zero when adjusted for a minimum lifting height. Immediately above the actuator (43), the holding actuator (44) is installed on the slide (33). This actuator (44) does not activate a selection body provided in the hook, but has a holding latch (45) instead of push surfaces. The holding latch (45) may hold a hook (1) in the upper position by means of the holding nose (65). Via a fastening (37), the slide (33) is connected to an element (39) of the holding grid (31) via a holding rod (38). This holding grid (31) is adjustable as to height and as to inclination, corresponding with the lifting and inclination performed by the knives (50), (51).

A jacquard machine has a large number of rows of knives (50), (51) and similar hooks (1) with actuator platforms (32), (33). A number of hooks (1), fixed actuators (40), (41) and sliding actuators (42), (43), (44) are brought together in a module or cassette. This module will contain two rows of actuators (40), (41), (42), (43), (44) back-to-back and a row of hooks (1) will be provided on both sides, in such a way that each row of knives (50), (51) may work for two rows of hooks (1).

Figures 7, 8, 9, 10:
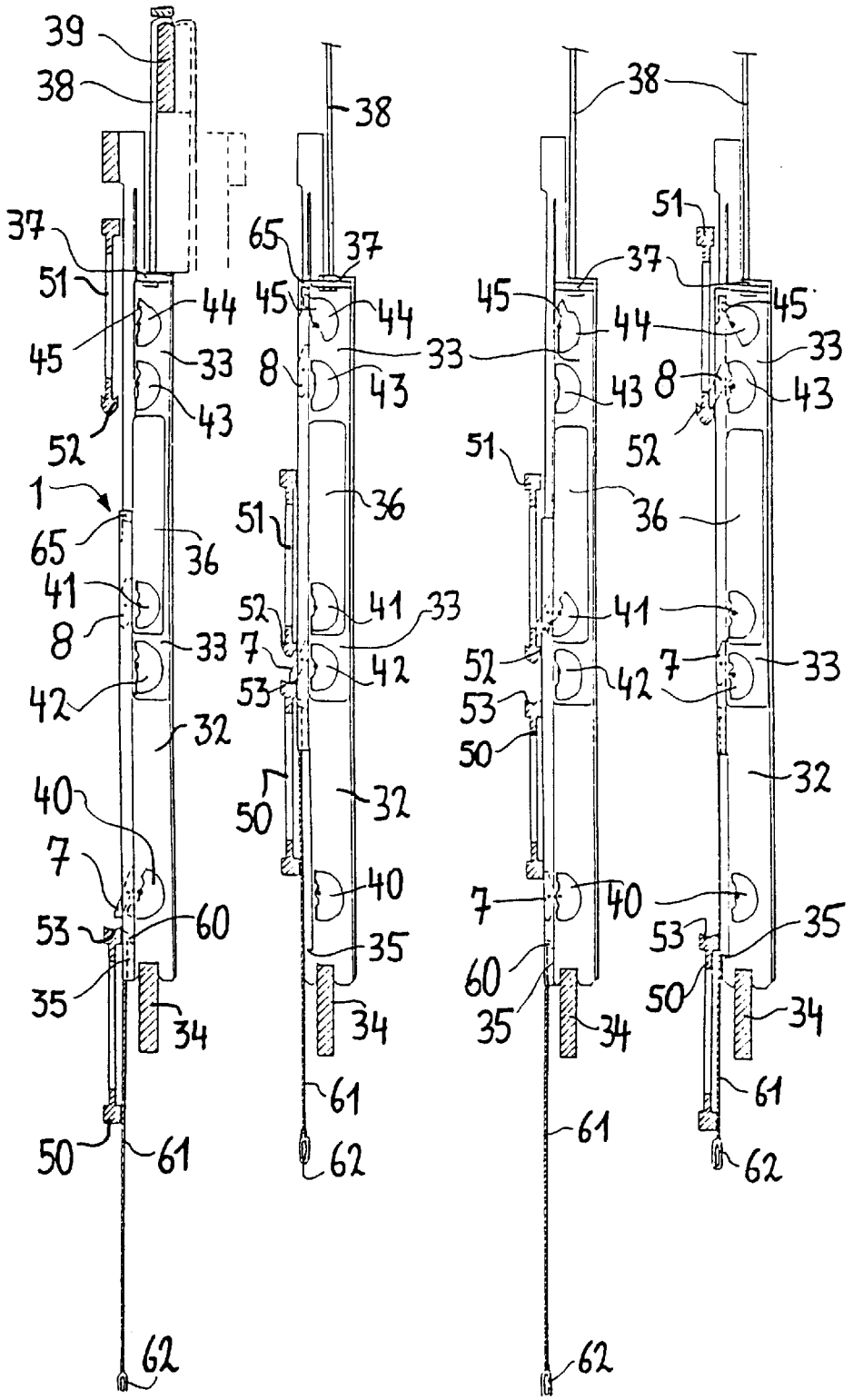

In the following, the different situations represented in the FIGS. 7 to 10 will be pursued in greater depth. FIG. 7 represents the situation where the upper knife (51) is situated in its upper dead point and the lower knife (50) is situated in its lower dead point. With its supporting nose (60), the hook (1) rests on the protrusion (35) that is connected to the wall (32), which rests on the element (34) of the bottom grid (30). If the hook (1) should stay below for a following pick or weft insertion none of the actuators is activated and the two lower selection bodies (7), (8) stay out of reach of the knives (50), (51). The hook (1) will always stay on the bottom grid (30). Should the hook (1) be brought into the upper position, then the lower actuator (40) is activated clockwise, whereby the lower selection body (7) comes within the pick-up range of the lower knife (50). The hook (1) will be taken along by the lower knife moving upwards, resting on the support surface (53). Note that the rotating movement of the actuator (40) hits the lower selection body (7) in the direction of the movement of the hook (1), so that the actuator (40) cannot be jammed by the hook (1).

Then, under the influence of the springs (22), (23), the actuator (40) immediately returns into a neutral position. If this actuator, for some reason, should get stuck, then the wedged surface at the top of the supporting nose (60) will provide for the actuator (40) to be pushed back into its starting position. During the upward movement of the lower knife (50), the hook (1) is kept on the knife (50) by the spring reaction of the harness. If during this movement the jacquard machine should be suddenly stopped, then the hooks (1) may temporally leave the knife. In order to make sure that the selection bodies remain in their stable position within the pick-up range of the knives (50), (51) the above-mentioned mechanism with compression spring (14) is provided. The preload of this compression spring (14) should be sufficiently strong so that the position of the selection body should be maintained under all circumstances. Neither should the upper lifting knife (51) have a protruding edge above the bearing surface (52) nor any material that the selection body (7), (8), (9) might hit. Since the selection body must be able to spring up from the lifting knife (51) over a certain height and the position of the selection body should not get lost by this movement.

A hook (1) that has reached the upper position is represented in FIG. 8. The upper knife (51) and the lower knife (50) have reached their upper and lower dead points respectively. If the hook (1) during a following weft insertion should be back down, none of the actuators (40), (41), (42), (43), (45) is activated and the hook (1) will go down with the lower knife (50) to the lower position. If, on the contrary, the hook (1) should remain up, then the holding actuator (44) will be activated in an anti-clockwise sense, whereby the holding latch (45) comes underneath the holding nose (60). When the knife (50) goes down, the holding nose (65) will continue to rest on the holding latch (45) and the hook (1) is kept up. While the knife (50) goes down the actuator (42) is activated in an anti-clockwise sense in order to bring the lower selection body (7) out of reach of the knives. If the hook (1) should go down at the following weft insertion the actuator (43) will be activated in a clockwise sense during the upward movement of the upper knife (51), whereby the upper selection body (8) comes within reach of this knife (51). In its upper dead center, the knife (51) moving upwards will lift the hook (1) slightly, the holding actuator (44) is activated in a clockwise sense, whereby the holding latch (45) will no longer support the holding nose (65) and the hook (1) will be brought down by the knife (51). If the hook should stay in the lower position, the position of the lower selection body (7) will be changed by activating the lower actuator (40) in an anti-clockwise sense. Note that this actuator (40) will hit the selection body (7) in a downward direction and therefore will contribute to the hook being kept on the bottom grid (30).

In FIG. 9 the hook (1) is in its lower position and the upper knife (51) and the lower knife (50) have reached their lower and upper dead point respectively. If the hook should stay down none of the actuators will be activated. If, on the contrary, the hook should be moved upwards, then the fixed actuator (41) will be activated in a clockwise sense, whereby the upper selection body (8) will be hooked on to the upper knife (51) and will be brought into the upper position by this upwards moving knife (51). This position is indicated in FIG. 10. In the upper position, the hook (1) may be kept there once more, or come down again with the knife.

From the preceding description appears that the hooks (1) may be brought into two different positions and may be hold in each of these positions and that from each position the other position may be reached. Therefore, this device functions according to the open-shed principle. The device has not a single pulley device and therefore the problems of the pulley cords wearing away and the pulleys getting jammed are unknown. Lifting and inclination of the jacquard machines are adjustable over a wide range. This is obtained in a simple manner by adjusting a holding grid (31), to which the slides (33) with the actuators (42), (43), (44) have been fastened to activate the selection bodies (7), (8), (9) in the upper position. The hooks (1) may be situated in three different situations: either they rest on the bottom grid (30) in a lower position, or they rest on a holding grid in an upper position, or they are coupled to a knife (50), (51), following its movement.

If a hook is in its lower position, only one actuator (40) should be activated to change the situation of the hook (1). If a hook is in its upper position, then two actuators should be activated to make the hook change its situation. Activating the actuators is needed only then when the hook should be changed from one situation into the other. In other words, a hook that should carry out a movement for a linen weave or should stay floating in the upper or lower position up or down, has to be activated only at the beginning or at the end of the successive cycles. Therefore, the device will have a lower consumption of electric energy. Moreover, the device has all the advantages of bottom selection: the hooks on the bottom grid (30) do not perform a short lifting in order to carry out the selection. In the upper position, only those hooks, which should go down, will be lifted slightly to release the holding latch (45) so that it may resume its neutral position. The other hooks (1), which should stay up, will not be lifted at all. There will be no more friction at the points the harness cords (61) are guided through in consequence of short selection liftings at each pick. Consequently, the duration of the harness cords will be prolonged.

By a judicious arrangement of the knives (50), (51) the installation of a supporting nose (60) at the bottom of the hook (1) and a holding nose (65) at the top of the hook (1) and the installation of the actuators (40), (41), (42), (43), (44), (45) the hook (1) may be kept relatively short and a jacquard device of limited height is obtained. Because the knives (50), (51) may be placed one above the other, more hooks can be installed in a specific depth of jacquard machine. Moreover, cassettes may be used in back-to-back position, so that one row of knives (50), (51) may operate two rows of hooks.

In an alternative embodiment of a jacquard machine according to this invention (see FIGS. 11 through 15) the two knives are provided to move up and down in opposition in two planes situated one beside the other. The hooks (1) are then substantially U-shaped elements with two parallel legs (70), (71) connected to each other by a bridging part (72). The harness cord (61) is connected to the hook (1) in the middle of this bridging part (72). At the top of each leg (70), (71) a respective selection body (7), (8) with compression spring (14) and a respective holding nose (73), (74) are provided. This fork-shaped hook (1) works between the knives (50), (51). The two legs (70), (71) of the hook (1) may be likewise connected to each other by means of a hinging point. What is important, is that both legs (70), (71) go up or down together.

In the FIGS. 12 through 15 each time two knives (50), (51) a fork-shaped hook (1), co-operating with these knives with accompanying actuators (80), (81), (82), (83) are represented in four different situations. In FIG. 12 the hook (1) rests with its bridging part (72) on the bottom grid (30). Level with the selection bodies (7), (8) the actuators (80), (81) are provided back-to-back one beside the other on a first fixed platform (32) or a wall, which rests on the bottom grid (30). Two other actuators (82), (83) are installed side by side on a second platform (33) or slide above the actuators (82), (83) mentioned first. Above these actuators (82), (83) an actuator (84) with holding latch (31) is provided. The slide (33) is connected to a jointly adjustable holding grid (31) or may be adjusted separately by means of an individual adjusting spindle (85).

As long as none of the actuators (80)–(84) is activated, the hook (1) will stay on the bottom grid (30). In case the hook (1) should be lifted, the actuator (80) will be activated in a clockwise sense and selection body (7) will come within the pick-up range of the left knife (50). The hook (1) will be taken along together with this knife (50) (See FIG. 13). In the upper position the hook (1) may now be lowered again by not activating any of the actuators (80)–(84) or the hook (1) may be kept up by activating the actuator (84) with holding latch in a anti-clockwise sense, and actuator (82) in order to bring the selection body (7) back into the position outside the pickup range of the knife (50). The hook (1) may be kept up as long as is required by the weaving pattern. The hook then rests with its supporting nose (73) on the holding latch.

Should the hook (1) be brought down again, then actuator (82) or (83) will be activated before one of the respective knives (50) or (51) has reached its upper dead center, so that the selection body (7), (8) co-operating with the knife (50), (51) moving upwards at that time will be lifted by that knife and the holding latch (84) will be activated in a clockwise sense as well. The hook (1) will then be moved downwards by the knife (50), (51) concerned (see FIG. 14). Then the hook (1) may be kept once more on the bottom board (30) or it may be allowed to move upwards again (see FIG. 15).

This device also works according to the open-shed principle, has no pulley device and offers all the advantages described above.

What is claimed is:

1. Shed-forming device, comprising at least one shed-forming element (1) for determining the positions of one or more warp yarns on a weaving device, a lifting means (50), (51) provided for moving up and down the shed-forming element (1), and at least one actuator provided for influencing the shed-forming element (1) in a selective manner, so that the shed-forming element either stays at a fixed height, or is moved by the lifting means (50), (51), characterized in that each shed-forming element (1) comprises at least one selection body (7), (8), (9), which for the said selective influencing is placed into a first or a second stable position, as desired, by means of the at least one actuator.

2. Shed-forming device according to claim 1, characterized in that the selection body (7), (8), (9) is movable between two end positions with respect to the shed-forming element (1) and that the shed-forming element (1) comprises a push means (14) which is provided to exert a force on the selection body (7), (8), (9) which counteracts the movement of the selection body from each end position in the direction of the other end position, so that the selection body (7), (8), (9) is kept stable in the said end positions.

3. Shed-forming device according to claim 1 or 2, characterized in that the push means (14) is a spring which on one side is connected to the selection body (7), (8), (9), and on the other side to the shed-forming element (1), so that the spring force exerted on the selection body (7), (8), (9), counteracts the movement of the selection body from each end position.

4. Shed-forming device according to claim 2, characterized in that the shed-forming element (1) comprises two stops, which limit the path of movement of the selection body and determine the said end positions.

5. Shed-forming device according to claim 4, characterized in that each selection body (7), (8), (9) is installed opposite an opening (12) provided in a wall (2) of the shed-forming element (1) and protrudes through this opening (12) in at least one of its stable positions and in that the said stops are formed by the respective edges of this opening (12).

6. Shed-forming device according to claim 2, characterized in that each selection body (7), (8), (9) is rotatable with respect to the shed-forming element (1) between the said stable positions.

7. Shed-forming device according to claim 1, characterized in that each shed-forming element (7), (8), (9) is selectively influenced by means of the at least one actuator, the installation height of which is variable.

8. Shed-forming device according to claim 1, characterized in that at least one selection body (7), (8), (9) of each shed-forming element (1) is selectively influenced by means of at least two actuators (40), (41); (42), (43); (80), (82); (81)–(83), installed at different levels and that the difference in height is variable between these levels.

9. Shed-forming device according to claim 1, characterized in that each shed-forming element (1) comprises at least one selection body (7), (8), (9), that is provided to come within the pick-up range of the lifting means (50), (51), in a first stable position, so that the selection body (7), (8), (9) rests on the lifting means (50), (51), whereby the shed-forming element is moved to be situated outside the pick-up range in a second stable position.

10. Shed-forming device according to claim 1, characterized in that the shed-forming device comprises two lifting means (50), (51) movable up and down in opposition, in that each shed-forming element (1) comprises two selection bodies (7), (8), which are provided to come within the pick-up range of a respective lifting means (50), (51), in a first stable position, so that the shed-forming element (1) is moved by means of the lifting means (50), (51) to stay out of this pick-up range in a second stable position.

11. Shed-forming device according to claim 10, characterized in that the two lifting means (50), (51) are either provided to move up and down in opposition one above the other, or to be provided to move up and down in opposition one beside the other.

12. Shed-forming device according to claim 1, characterized in that this device comprises a holding means (31) for each shed-forming element and in that each shed-forming element (1) comprising the selection body (9) adapted to come into a holding position with respect to the holding means (31) in a first stable position, where the shed-forming element (1) is kept at a fixed height by a co-operation with the holding means (31) and is adapted to come into a non-holding position with respect to the holding means (31) in a second stable position.

13. Shed-forming device according to claim 12, characterized in that the height of installation of the holding means (31) is adjustable.

14. Shed-forming device according to claim 1, characterized in that the device comprises plural selection bodies and plural actuators, wherein each selection body (7), (8), (9) and each actuator cooperating with the selection body is carried out in such a way that the force which is exerted by each of the actuators on each of the respective selection body (7), (8), (9) to move the respective selection body from one stable position into another stable position, and the force exerted by the actuator is exerted in a direction where this force cannot be counteracted by a force which is the consequence of a movement of the shed-forming element (1) by the lifting means (50), (51).

15. Shed-forming device according to claim 14, characterized in that each actuator comprises a movable push element (16) with which a selection body (7), (8), (9) is pushed from the first into the second stable position and from the second into the first stable position respectively.

16. Shed-forming device according to claim 15, characterized in that each actuator comprises a driving means (20, 21); (25) with which the push element (16) is placed into a first and a second push position to bring the selection body (7), (8), (9) into the first and second stable position respectively, and in that the push element (16) is provided to take up a neutral position between these push positions when the driving means exerts no driving force on the push element.

17. Shed-forming device according to claim 15 or 16, characterized in that the push element (16) is linearly movable or rotatable between the said push positions.

18. Shed-forming device according to claim 16, characterized in that each actuator comprises an electromagnetic driving means (20), (21) to move the push element (16).

19. Shed-forming device according to claim 1, characterized in that this device comprises a series of shed forming-elements (1) which are movable up and down by means of one or more lifting means (50), (51) and comprises a number of holding means (39) to keep these shed-forming elements (1) at a fixed height and in that a number of holding means (39) cooperating with several shed-forming elements (1) are part of a same holding construction (31) which is installed in an inclined position, so that the height of installation is gradually increasing in the direction of the inclination.

20. Shed-forming device according to claim 1, characterized in that this device comprises a series of shed-forming elements (1) which are movable up and down by means of one or more lifting means (50), (51) and in that for at least one selection body (7), (8), (9) of each shed-forming element (1) one actuator is provided at a height which corresponds to the height of the selection body when the shed-forming element is moved upwards over a lifting height (h), (h') by a lifting means (50), (51), and in that a number of actuators co-operating with several shed-forming elements (1) are part of a same supporting construction (33) installed in an inclined position, so that the height of installation of the actuators is gradually increasing in the direction of the inclination.

21. Shed-forming device according to the claims 19 and 20, characterized in that the said holding construction (31) and the said supporting construction (33) are connected to each other or together form one unit.

22. Shed-forming device according to claim 19, characterized in that the said holding construction (31) and/or the said supporting construction (33) installed in several positions with a different inclination.

23. Shed-forming device according to claim 1, characterized in that each shed-forming element (1) is movable between a lower and an upper position by means of a first and a second lifting means (50), (51) that are movable up and down in opposition, in that each shed-forming element (1) comprises a first (7) and a second selection body (8), in that a first and a second actuator are provided per shed forming-element (1) in order to co-operate with the first selection body (7) when the shed-forming element (1) is in its lower position and in its upper position respectively, and in that a third actuator and a fourth actuator are provided per shed-forming element (1) in order to co-operate with the second selection body (8) when the shed-forming element (1) is in its lower position and in its upper position respectively.

24. Shed-forming device according to claim 1, characterized in that wherein the device is a jacquard machine comprising a weaving device with the warp yarns being brought into two different positions according to an open-shed principle.

25. Shed-forming device according to claim 1, characterized in that a number of actuators and/or hooks (1) are provided in a common module or cassette (24).

26. Shed-forming device according to claim 25, characterized in that at least one module or cassette (24) comprises the actuators for two different rows of hooks.

27. Shed-forming element (1) to determine the positions of one or several warp yarns on a weaving device, provided to be selectively influenced by an actuator of a shed-forming device, characterized in that the shed-forming element (1) comprises at least one selection body (7), (8), (9) which, for the said selective influencing, is placed into a first or a second stable position, as desired, by means of the actuator.

28. Shed-forming element (1) according to claim 27, characterized in that the selection body (7), (8), (9) is movable between two end positions with respect to the shed-forming element (1), and in that the shed-forming element (1) comprises a push means (14) which is provided to exert a force on the selection body (7), (8), (9) which counteracts the movement of the selection body from each end position in the direction of the other end position, so that the selection body (7), (8), (9) is kept stable in said end positions.

29. Shed-forming element (1) according to claim 28, characterized in that the push means (14) is a spring which on one side is connected to the selection body (7), (8), (9) and on the other side to the shed-forming element (1), so that the spring force exerted on the selection body counteracts the movement of the selection body (7), (8), (9) from each end position.

30. Shed-forming element (1) according to claim 28, characterized in that each selection body (7), (8), (9) is rotatable between the said stable positions with respect to the shed-forming element (1).

31. A jacquard machine comprising the shed-forming element (1) according to claim 27.

* * * * *